US005115217A

United States Patent [19]

McGrath et al.

[11] Patent Number: 5,115,217

[45] Date of Patent: May 19, 1992

[54] RF TUNING ELEMENT

[75] Inventors: William R. McGrath, Monrovia; Victor M. Lubecke, Whittier, both of Calif.

[73] Assignee: California Institute of Technology, Pasadena, Calif.

[21] Appl. No.: 622,939

[22] Filed: Dec. 6, 1990

[51] Int. Cl.[5] ..... H01P 1/28

[52] U.S. Cl. ..... 333/246; 333/263; 343/700 MS; 455/327

[58] Field of Search ..... 333/161, 205, 225, 235, 333/246, 253, 263; 455/325, 327, 330; 343/700 MS File

[56] References Cited

U.S. PATENT DOCUMENTS

| | | | |
|---|---|---|---|
| 2,543,721 | 2/1951 | Collard et al. | 333/263 |
| 2,752,499 | 6/1956 | Hanthorn | 333/225 X |
| 2,915,717 | 12/1959 | LaRosa | 333/235 |
| 2,961,620 | 11/1960 | Sommers | 333/161 |
| 3,405,375 | 10/1968 | Kelley | 333/161 |
| 3,421,118 | 1/1969 | Engelbrecht | 333/263 X |
| 4,096,453 | 6/1978 | Rogers | 333/246 X |
| 4,955,085 | 9/1990 | Woody | 455/325 X |

*Primary Examiner*—Paul Gensler
*Attorney, Agent, or Firm*—Loyal M. Hanson

[57] ABSTRACT

A device for tuning a circuit includes a substrate, a transmission line on the substrate that includes first and second conductors coupled to a circuit to be tuned, and a movable short-circuit for varying the impedance the transmission line presents to the circuit to be tuned. The movable short-circuit includes a dielectric layer disposed atop the transmission line and a distributed shorting element in the form of a conductive member that is configured to be slid along at least a portion of the transmission line atop the dielectric layer. The conductive member is configured to span the first and second conductors of the transmission line and to define at least a first opening that spans the two conductors so that the conductive member includes first and second sections separated by the first opening. The first and second sections of the conductive member combine with the first and second conductors of the transmission line to form first and second low impedance sections of transmission line, and the opening combines with the first and second conductors of the transmission line and the dielectric layer to form a first high impedance section of transmission line intermediate the first and second low impedance sections. Each of the first low impedance section and the first high impedance section have a length along the transmission line of approximately one-quarter wavelength, thus providing a periodic variation of transmission line impedance. That enhances reflection of rf power.

14 Claims, 4 Drawing Sheets

RF TUNING ELEMENT

ORIGIN OF INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Technical Field

This invention relates generally to rf circuitry, and more particularly to a tuning element for planar rf circuits operating in the microwave, millimeter wave, and submillimeter wave range.

2. Background Information

Planar rf circuits find many uses at frequencies of 1–1000 GHz or more. But those frequencies can complicate circuit design because the circuit designer may lack sufficiently well-characterized devices, accurate knowledge of materials properties, and well-developed calculational techniques. So design often proceeds somewhat empirically with the inefficiencies and frustrations of trial and error.

To better visualize the problem, consider a typical planar rf circuit used with a mixer, oscillator, low-noise amplifier, coupler, phase-shifter, or the like, for application in radar, communications, or microwave test equipment. Commonly formed on a substrate and referred to as a microwave integrated circuit (MIC) or monolithic microwave integrated circuit (MMIC), the planar rf circuit usually includes rf tuning elements in the form of transmission lines. They may be microstrip lines, coplanar lines, or slotlines formed on the same substrate, and the circuit designer uses them as distributed rf tuning elements to optimize circuit performance.

In other words, the circuit designer adds lengths of open-circuited or short-circuited transmission line (i.e., tuning stubs) at selected points in the circuit in order to introduce impedances that improve circuit performance. Although the designer can add a wide range of complex impedances in that way to fine tune the circuit, he must know materials parameters such as dielectric constants, absorption coefficients, and metallic conductivities to design the transmission lines and make the design repeatable. In addition, he must use active devices for which the high-frequency electrical response must be accurately characterized and he needs accurate calculational design tools. Such requirements are usually difficult if not impossible to meet and so they severely limit the design process. It is therefore desirable to have a better way to tune planar rf circuits.

SUMMARY OF THE INVENTION

This invention alleviates the problem outlined above by providing an adjustable tuning element. It includes a planar transmission line and a movable rf short-circuit. The movable rf short-circuit can be moved to any of various positions along the transmission line to produce any of a wide range of complex impedances, and that frees the circuit designer from the limitations associated with fixed-length lines or other fixed tuning elements.

Generally, a tuning element constructed according to the invention includes a substrate, a transmission line on the substrate that includes first and second conductors coupled to a circuit to be tuned, and a movable short-circuit for varying the impedance the transmission line presents to the circuit to be tuned. The movable short-circuit includes a dielectric layer disposed atop the transmission line and a distributed shorting element in the form of a conductive member that is configured to be slid along at least a portion of the transmission line atop the dielectric layer. The conductive member is configured to span the first and second conductors of the transmission line and to define at least a first opening that spans the two conductors so that the conductive member includes first and second sections separated by the first opening. The first and second sections of the conductive member combine with the first and second conductors of the transmission line and the dielectric layer to form first and second low impedance sections of transmission line, and the opening combines with the first and second conductors of the transmission line to form a first high impedance section of transmission line intermediate the first and second low impedance sections. Each of the first low impedance section and the first high impedance section have a length of approximately one-quarter wavelength along the transmission line, thus providing a periodic variation of transmission line impedance that enhances reflection of rf power.

Preferably, the conductive member takes the form of a thin metallic plate arranged to be slid along the transmission line atop the dielectric layer which is disposed over the two conductors (such as by depositing a silicon oxide material over the conductors). The plate is configured to define at least one opening so that it provides at least two, spaced-apart, low impedance paths. They produce a periodic variation of the transmission line impedance in a way that enhances reflection of rf power. Multiple openings of appropriate size and spacing provide a large rf reflection over a useful frequency bandwidth, and the structure is rugged and easy to fabricate. Guide rails may be used to retain the plate in alignment with the transmission line. In addition, the plate may be configured with a protruding tab that extends between the two conductors of a coplanar transmission line into a slot in the substrate. That helps intersect the electromagnetic field within the substrate and provide a better short circuit (i.e., a low impedance path).

In line with the above, a method of tuning a circuit includes the step of providing a planar transmission line coupled to a circuit to be tuned and a movable short-circuit for varying the impedance the planar transmission line presents to the circuit to be tuned. The method proceeds by moving the movable short-circuit in order to vary the impedance the transmission line presents to the circuit to be tuned. Preferably, the movable short-circuit includes a conductive plate configured to produce a periodic variation in transmission line impedance in order to enhance reflection of rf power.

The foregoing and other objects and features of the invention will become more apparent and the invention itself will be better understood by reference to the following detailed description taken in conjunction with the accompanying illustrative drawings.

DESCRIPTION OF THE PREFERRED EMBODIMENTS

Figure 1:
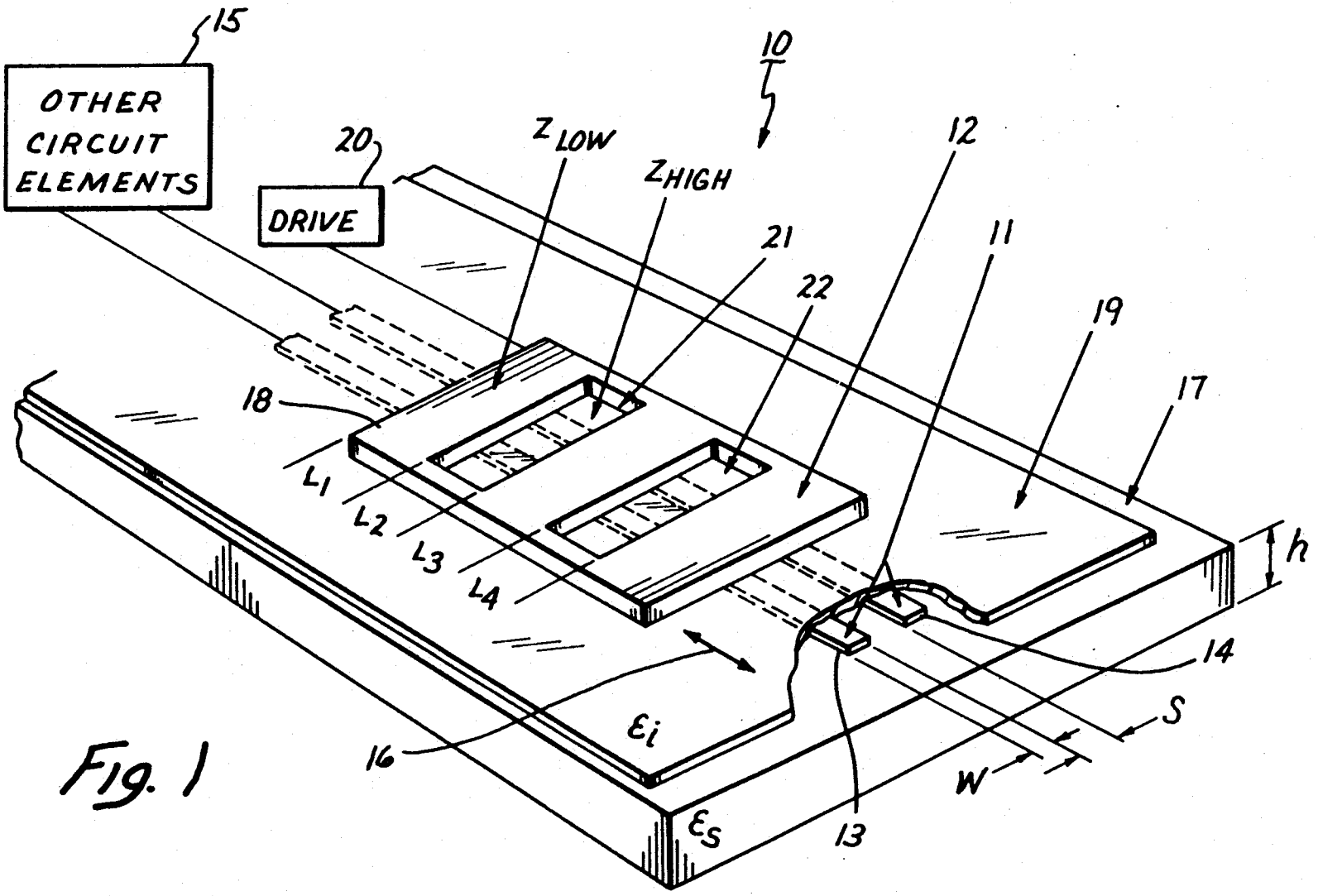
FIG. 1 of the drawings is a perspective view of a first embodiment of a tuning element constructed according to the invention, diagrammatically interconnected to other circuit elements and mechanical drive componentry.

FIG. 1 shows a tuning element 10 constructed according to the invention. Generally, it includes a transmission line 11 and a movable short-circuit, such as that provided by a conductive plate labelled "sliding tuner 12." The transmission line 11 includes two conductors 13 and 14 that are coupled to a circuit to be tuned, such as the circuit 15 shown diagrammatically, and the sliding tuner 12 is so configured that it can be moved along the transmission line 11 (in the directions indicated by an arrow 16) to any of various locations in order to provide a low impedance path between the two conductors 13 and 14. Doing so varies the impedance the transmission line 11 presents to the circuit 15 and so one can tune the circuit 15 by moving the sliding tuner 12.

The transmission line 11 can take any of various known forms of planar transmission line within the broader inventive concepts disclosed, and the circuit 15 may include one or more known circuit elements. They may be fabricated together on a single substrate as a MIC or MMIC, for example. The illustrated transmission line 11 employs a known type of coplanar transmission line configuration on a substrate 17 of dielectric constant $\epsilon_s$. The substrate material, its thickness or height "h," the width "w" of the two conductors 13 and 14, and the distance "s" between the conductors are chosen in a known way so that the transmission line 11 has a desired characteristic impedance, $Z_c$.

The movable short-circuit can take various forms also within the broader inventive concepts disclosed and the sliding tuner 12 may include various components. As illustrated, it includes at least a rectangular aluminum plate 18 that slides atop a thin insulator 19 of dielectric constant $\epsilon_i$ that is disposed over the transmission line 11 to reduce mechanical wear and allow the sliding tuner 12 to operate freely. The plate 18 is readily produced using conventional machining, laser machining, or metal etching techniques, and suitable mechanical componentry shown diagrammatically in FIG. 1 by a block labelled "drive 20," may be included to drive the plate 18 in the directions indicated by the arrow 16. Thus, the sliding tuner 12 may be said to be so configured that a user can move it along the transmission line 11 to vary the location of the low impedance path it provides between the conductors 13 and 14 in order to thereby vary the impedance the transmission line 11 presents to the circuit 15. The drive 20 may take various forms such as a micrometer coupled to the plate 18 by a thin connecting wire and even include micro-gears fabricated with currently available silicon micro-machining techniques. Other applications might bond the plate 18 in a selected position during fabrication of production models once the desired position is determined during prototype development.

According to another aspect of the invention, the movable short-circuit is configured to provide at least two spaced-apart low impedance paths between the conductors 13 and 14 (more specifically, distributed low impedance sections of transmission line formed by the movable short-circuit and conductors 13 and 14) in order to produce a periodic variation of transmission line impedance and thereby enhance reflection of rf power. That is accomplished for the illustrated tuning element 10 by so configuring the plate 18 that it defines at least one and preferably at least two spaced apart openings (labelled openings 21 and 22 in FIG. 1).

Thus, the plate 18 includes a series of sections having lengths $L_1$–$L_4$ in FIG. 1, the sections having lengths $L_1$ and $L_3$ providing low impedance paths $Z_{low}$ between the conductors 13 and 14 (i.e., two low impedance sections of transmission line formed by the plate 18, the dielectric layer, and the conductors 13 and 14) and the sections having lengths $L_2$ and $L_4$ providing high impedance paths $Z_{high}$ (i.e., high impedance sections of transmission line. Each section is approximately $\frac{1}{4}\lambda_g$ along the transmission line 11 (in the direction of the arrow 16), where $\lambda_g$ is the wavelength on the transmission line 11. The rf impedance of the sliding tuner 12 is given approximately by the known equation $$Z_{rf}=(Z_{low}/Z_{high})^n Z_c$$

where $Z_{low}$ is the impedance of the sections having lengths $L_1$ and $L_3$, $Z_{high}$ is the impedance of the sections having lengths $L_2$ and $L_4$, Zc is the characteristic impedance of the transmission line 11, and "n" is the number of sections (provided there are an even number of sections). That equation is correct for TEM mode propagation and is only approximately valid for the near-TEM mode propagation on the coplanar transmission line 11. However, it shows that values of $Z_{rf}$ less than one ohm (a good short circuit) should be possible.

As a further idea of size and construction, consider a large-scale tuning element constructed according to the invention that is designed to operate at 1–3 GHz in order to provide parameters that can be scaled to other operating frequencies. At that frequency, the transmission line may be formed on a six millimeter thick substrate composed of a dielectric material (such as the material sold under the trademark STYCAST by Emerson and Cuming Division of W. R. Grace and Company of Canton, Mass. for which $\epsilon_s=4$) and be configured with w=2.1 mm and s=5.2 mm. In that case, the transmission line 11 has a characteristic impedance, $Z_c$, of 204 ohms and an effective dielectric constant, $\epsilon_{eff}$, of 2.3.

The insulator 19 may be a 0.025-mm thick sheet of dielectric material such as the dielectric material sold under the trademark MYLAR having a dielectric constant of 2.9, and the plate 18 may be a 6 mm thick sheet of aluminum measuring 76 mm wide (perpendicular to the direction of the arrow 16). The openings 21 and 22 are such that $L_1$=24.3 mm, $L_2$=19.4 mm, $L_3$=24.0 mm, and $L_4$=23.0 mm. In terms of wavelength, the length of the low impedance sections are $L_1=0.245\ \lambda_g$ and $L_3=0.243\ \lambda_g$, while the lengths of the high impedance sections are $L_2=0.196\ \lambda_g$ and $L_4=0.233\ \lambda_g$, where $\lambda_g$ is the wavelength on the transmission line 11 at 2 GHz and equal to 98.9 mm. Those lengths are all very close to $\frac{1}{4}\lambda_g$ which suggests near-TEM mode propagation on the transmission line 11. So, for purposes of developing a transmission line model for the high and low impedance sections of the plate 18, the high impedance sections may, as a first approximation, be treated as ordinary coplanar strip line and the low impedance sections are treated as coupled microstrip line.

Figure 2:
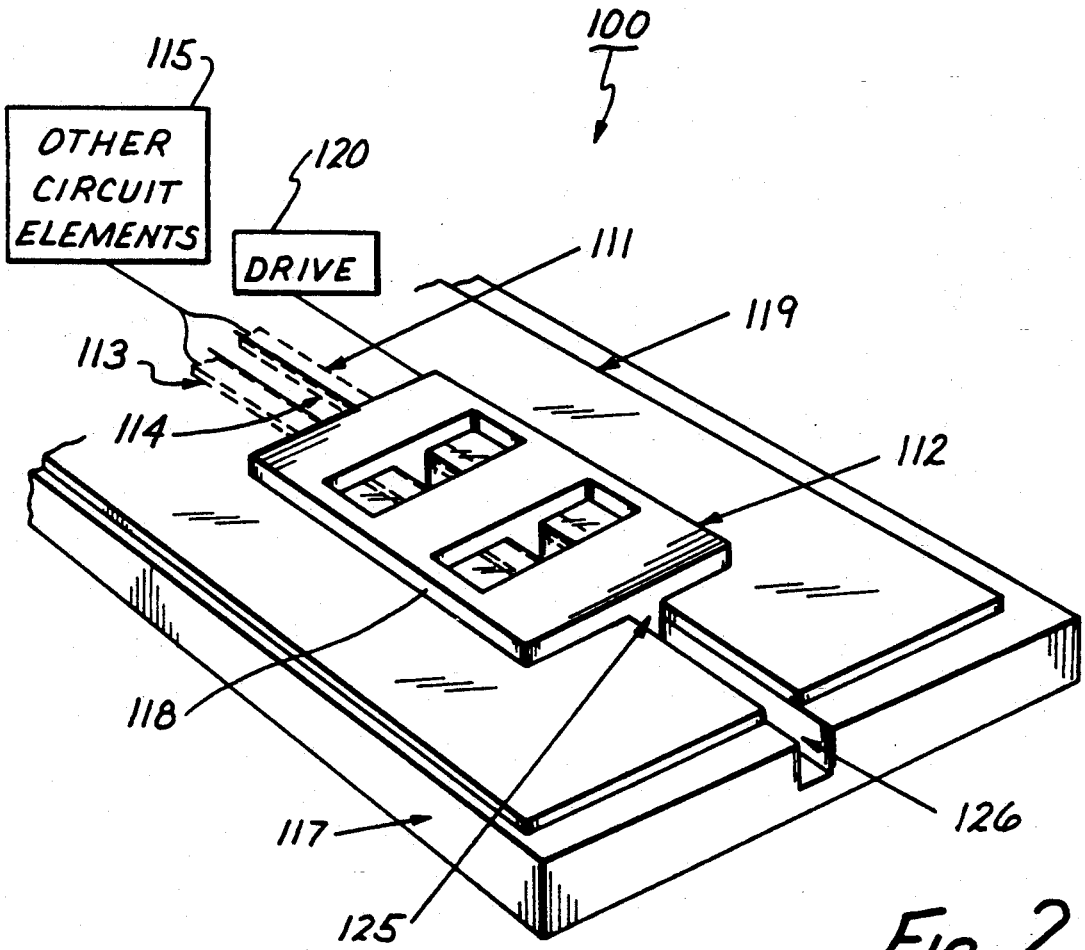
FIG. 2 is a perspective view of a second embodiment in which the sliding tuner includes a tab that rides in a slot between the transmission line strips.

The foregoing parameters and dimensions afford a better understanding of the tuning element 10 although they may be changed without departing from the broader inventive concepts disclosed. Moreover, the broader inventive concepts can be extended to other geometries and other types of transmission lines. Consider FIG. 2 for example. It shows a tuning element 100 constructed according to the invention. It is similar in many respects to the tuning element 10 so that only differences are described in further detail. For convenience, reference numerals designating parts of the tuning element 100 are increased by one hundred over those designating similar parts of the tuning element 10.

Similar to the tuning element 10, the tuning element 100 includes a transmission line 111 on a substrate 117 together with a sliding tuner 112 that slides atop an insulator 119 to provide a movable short-circuit. But unlike the tuning element 10, the plate 118 of the sliding tuner 112 includes a tab 125 that extends between the two conductors 113 and 114 of the transmission line 111 and into a slot 126 defined by the substrate 117. That arrangement helps maintain the sliding tuner 112 in alignment with the transmission line 111. It also helps produce a better short circuit (i.e., a low impedance path between the conductors 113 and 114) by intercepting more of the electromagnetic field between the two conductors 113 and 114. Preferably, the tab 125 extends the full length of the plate 118 before openings are formed in the plate 118 so that when the openings are formed, each low impedance section of the plate 118 includes a tab.

Figure 3:
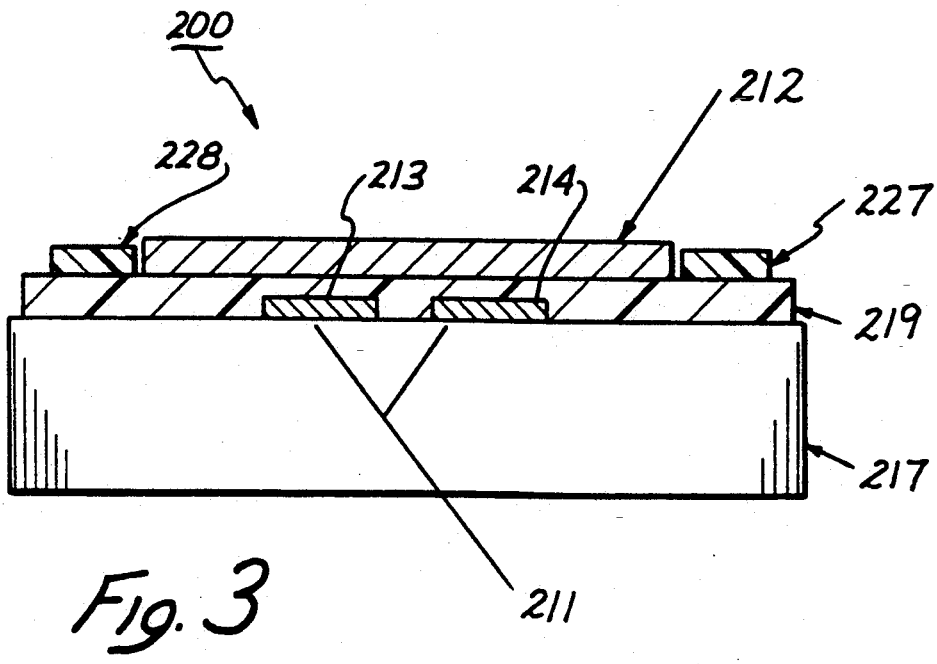
FIG. 3 is an enlarged cross sectional view of a third embodiment that includes a guide structure for the sliding tuner.

FIG. 3 shows a tuning element 200 that employs a different guiding arrangement. The tuning element 200 is also similar in many respects to the tuning element 10 so that only differences are described in further detail. For convenience, reference numerals designating parts of the tuning element 200 are increased by two hundred over those designating similar parts of the tuning element 10.

Similar to the tuning element 10, the tuning element 200 includes a transmission line 211 on a substrate 217, together with a sliding tuner 212 that slides atop an insulator 219 to provide a movable short-circuit. But unlike the tuning element 10, the sliding tuner 212 is maintained in alignment with the transmission line 211 by guide rails labelled guide 227 and guide 228 in FIG. 3. They may be strips formed of a suitable material, such as a polyamide material disposed on opposite sides of the sliding tuner 212 atop the insulator 219, and they extend alongside the transmission line 211 to form a slot in which the sliding tuner 212 rides as it moves along the transmission line 211.

Figure 4:
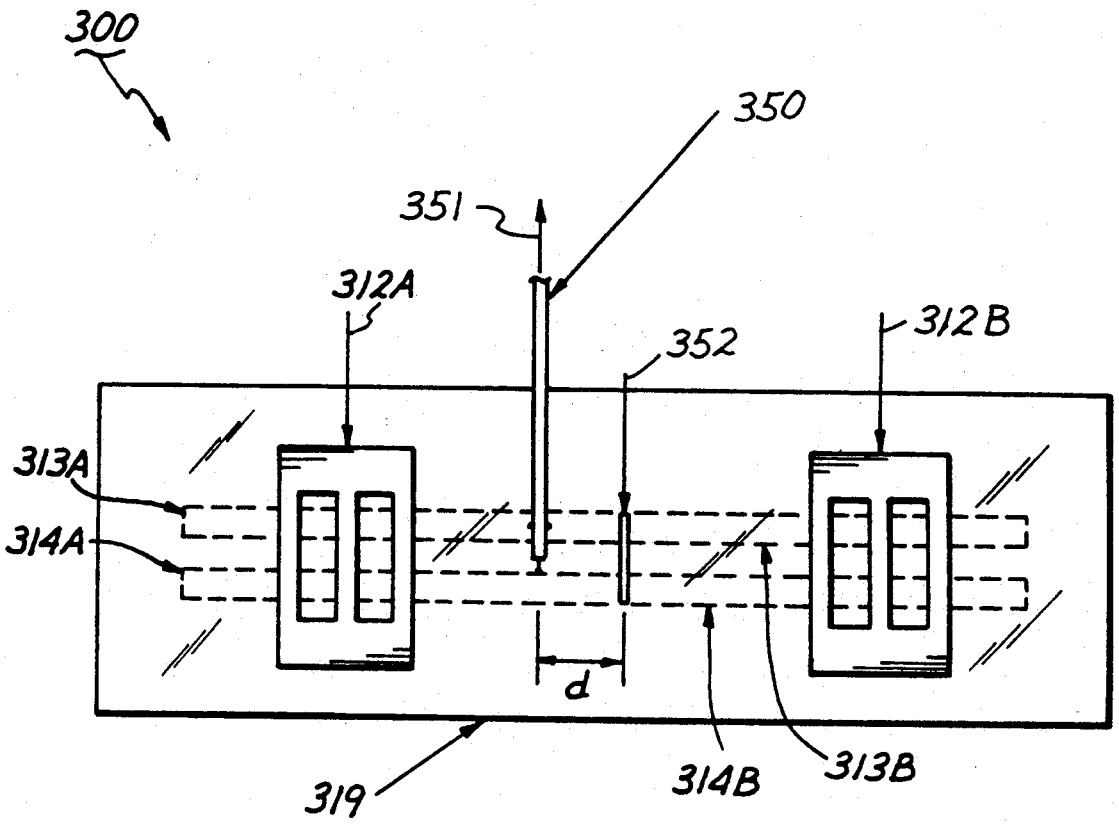
FIG. 4 is a plan view of a fourth embodiment that includes two sliding tuners.

FIG. 4 illustrates a double shunt tuner configuration 300 that combines two coplanar transmission lines. It is also similar in many respects to the tuning element 10 and reference numerals designating similar parts are increased by three hundred. A first sliding tuner 312A provides a movable short-circuit between conductors 313A and 314A while a second sliding tuner 312B provides a movable short-circuit between conductors 313B and 314B.

Known transmission line theory predicts that a wide range of impedances can be provided by such an arrangement, and a small coaxial probe may be connected as illustrated to a network analyzer (such as a Hewlett-Packard 8510 network analyzer) in order to measure the impedances. The conductors 313A and 314A are connected directly across the probe while the conductors 313B and 314B are connected a distance $d=\frac{1}{8}\lambda_g$ from the probe. A commercially available 200-ohm resistor terminates the line between the probe and the conductors 313B and 314B.

Figure 5:
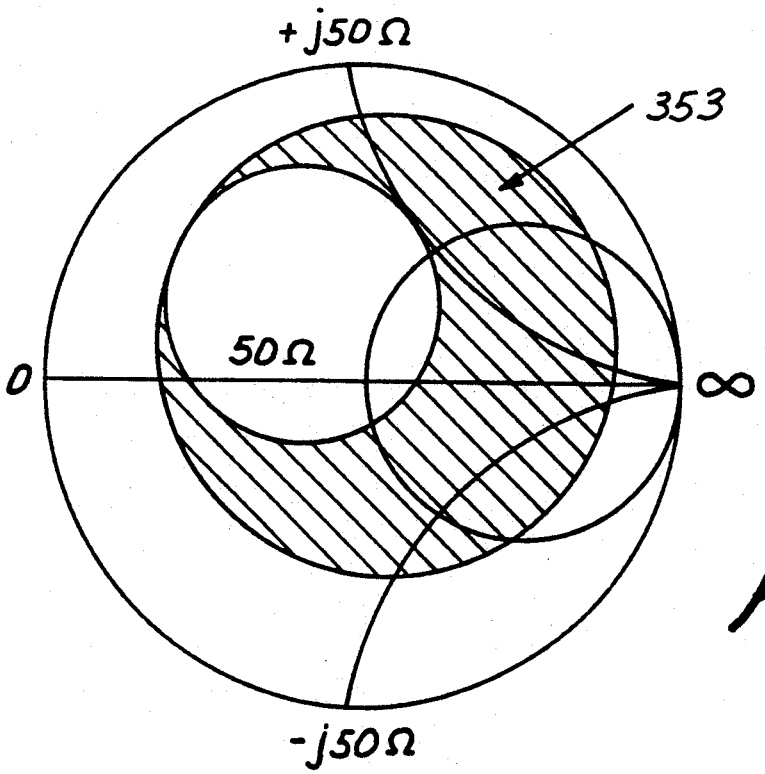
FIG. 5 is a Smith chart showing the range of complex impedances covered by the fourth embodiment.

Although the probe is coupled to the tuning elements for measurement purposes, it can be thought of as the circuit to be tuned in order to see where the circuit to be tuned is connected to the tuning elements. Measurements taken for various combinations of positions of the first and second sliding tuners 312A and 312B confirm the accessible range of impedances at 2 GHz shown as the shaded region of the Smith chart of FIG. 5. A wide range can be covered, and that is useful for many applications. A still larger range of impedances may be accessible by increasing the reflection coefficients of the sliding tuners 312A and 312B. Also, there can be large standing waves in the measurement technique so that even small conductive or radiative losses have a significant impact.

Figure 6:
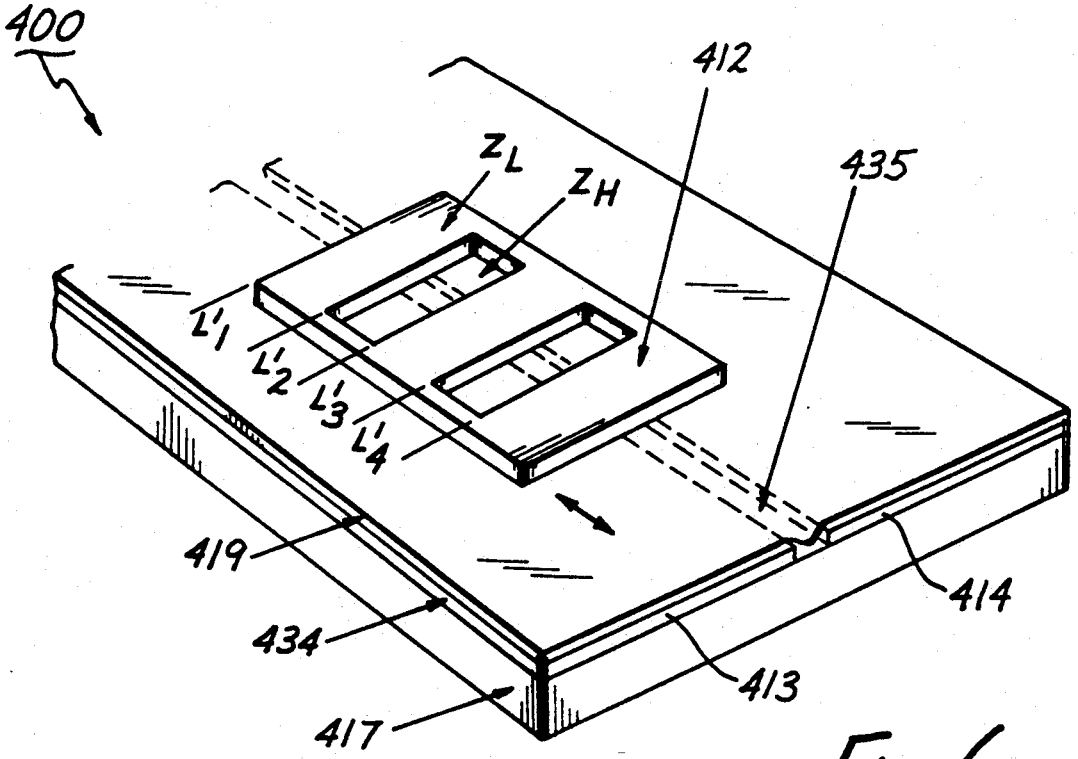
FIG. 6 is a fifth embodiment that includes a sliding tuner for a slotline.

FIG. 6 shows yet another tuning element configuration constructed according to the invention. It is labeled as tuning element 400. Reference numerals are increased by 400 over those designating similar parts of the tuning element 10. Unlike the tuning element 10, the tuning element 400 employs a slotline 435 formed with metallization 434 on a substrate 417, instead of a coplanar transmission, and a sliding tuner 412 that is similar in some respects to the sliding tuner 12 provides a movable short-circuit between the conductors 413 and 414. Since the electromagnetic fields of the slotline 435 are similar to those of the coplanar transmission line 11 in that they span a gap between the conductors 413 and 414, the sliding tuner 412 performs somewhat in the same way as described for the sliding tuner 12. However, the dimensions $L'_1$–$L'_4$ are different than the dimension $L_1$–$L_4$ in FIG. 1 in order to properly account for the effective wavelength on the slotline 435.

A sliding, noncontacting structure with periodic high impedance and low impedance sections, such as the sliding tuners already described, can be used to provide an adjustable periodic variation of microstrip line as well. In that case, the thickness of the top conductor of the line needs to be comparable to a penetration depth to allow the sliding tuner to interact strongly with the fields inside the line. In addition, such a movable short-circuit may be used on coplanar waveguide (the complement of the coplanar strip transmission line), and it is intended that any such applications fall within the scope of the claims.

Figure 7:
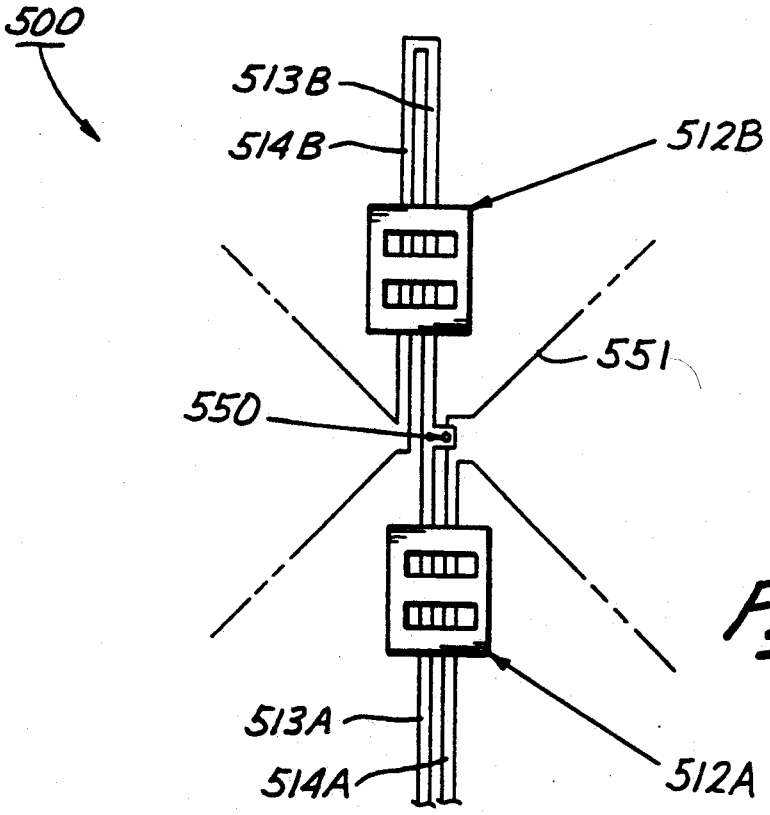
FIG. 7 is a schematic diagram of a mixer circuit with a superconductor-insulator-superconductor (SIS) junction device and two tuning elements.

Still another application of a tuning element constructed according to the invention improves superconductive SIS tunnel junction circuits, such as the SIS mixer circuit 500 shown in FIG. 7. It includes an SIS junction device coupled to a planar antenna in order to provide particularly low noise and high conversion efficiency at millimeter wave frequencies. However, SIS devices have a large parasitic capacitance and require a proper imbedding circuit for best performance. So, the mixer circuit 500 provides tuning with two tuning elements constructed according to the invention, one arranged to provide shunt tuning with a sliding toner labelled a "shunt tuner 512A" in FIG. 7 and the other arranged to provide series tuning with a sliding tuner labelled a "series tuner 512B." The shunt tuner 512A provides an adjustable short-circuit between the conductors 513A and 514*a*, and the series tuner 512B provides an adjustable short-circuit between the conductors 513B and 514B. That way, a broad range of impedances is available that allow the SIS mixer to be fully optimized.

Thus, the invention provides an adjustable tuning element in the form of a planar transmission line and a movable rf short-circuit. The movable rf short-circuit can be moved to any of various positions along the transmission line to produce any of a wide range of complex impedances, and that frees the circuit designer from the limitations associated with fixed-length lines or other fixed tuning elements.

Although an exemplary embodiment has been shown and described, many changes, modifications, and substitutions may be made by one having ordinary skill in the art without necessarily departing from the spirit and scope of the invention.

What is claimed is:

1. A device for tuning a circuit, comprising:

a substrate, a transmission line on the substrate that includes first and second conductors coupled to a circuit to be tuned, and means defining a movable short-circuit for varying the impedance the transmission line presents to the circuit to be tuned;

the means defining a movable short-circuit including a dielectric layer disposed atop the transmission line and a distributed shorting element in the form of a conductive member that is configured to be slid along at least a portion of the transmission line atop the dielectric layer;

the conductive member being configured to span the first and second conductors of the transmission line and to define at least a first opening that spans the two conductors so that the conductive member includes first and second sections separated by the first opening;

the first and second sections of the conductive member combining with the first and second conductors of the transmission line and the dielectric layer to form first and second low impedance sections of transmission line, and the opening combining with the first and second conductors of the transmission line to form a first high impedance section of transmission line intermediate the first and second low impedance sections; and at least each of the first low impedance section and the first high impedance section having a length along the transmission line of approximately one-quarter wavelength, thus providing a periodic variation of transmission line impedance that enhances reflection of rf power.

2. A device as recited in claim 1, wherein the conductive member includes a rectangularly shaped plate of conductive material and the first opening is a rectangularly shaped opening in the plate.

3. A device as recited in claim 1, wherein:

the conductive member defines a second opening that spans the first and second conductors of the transmission line so that the conductive member includes first, second, and third sections such that the first and second sections are separated by the first opening and the second and third sections are separated the second opening;

the first, second, and third sections of the conductive member combine with the first and second conductors of the transmission line and the dielectric layer to form first, second, and third low impedance sections of transmission line, and the first and second openings combine with the first and second conductors of the transmission line to form first and second high impedance sections of transmission line intermediate the first, second, and third low impedance sections; and at least each of the first and second low impedance sections and the first and second high impedance sections have a length along the transmission line approximately one-quarter wavelength, thus providing a periodic variation of transmission line impedance that enhances reflection of rf power.

4. A device as recited in claim 1, wherein the conductive member includes a rectangularly shaped plate of conductive material and the first and second openings are rectangularly shaped openings in the plate.

5. A device as recited in claim 1, wherein:

each of the first low impedance section and the first high impedance section have a length along the transmission line that is approximately one-quarter wavelength.

6. A device as recited in claim 1, wherein the transmission line is a coplanar strip transmission line.

7. A device as recited in claim 1, further comprising means for guiding the conductive member as the conductive member is moved along the transmission line.

8. A device as recited in claim 1, wherein the transmission line is a slotline.

9. A device for tuning a circuit, comprising:

a substrate;

a transmission line on the substrate, which transmission line is coupled to a circuit to be tuned; and means defining a movable short-circuit for varying the impedance the transmission line presents to the circuit to be tuned;

the movable short-circuit including a conductive member that is configured to be moved to any of various locations along the transmission line and to provide a low impedance path across the transmission line at any such location to which it is moved;

wherein the transmission line is configured as a coplanar strip transmission line having first and second conductors separated by a space; the substrate defines a slot in alignment with the space; and the conductive member includes a protrusion configured to extend intermediate the first and second conductors into the slot in order to reduce the impedance of the low impedance path provided by the conductive member.

10. A device for tuning a circuit, comprising:

a substrate;

a transmission line on the substrate, which transmission line is coupled to a circuit to be tuned; and means defining a movable short-circuit for varying the impedance the transmission line presents to the circuit to be tuned;

the movable short-circuit including a conductive member that is configured to be moved to any of various locations along the transmission line and to provide a low impedance path across the transmission line at any such location to which it is moved; and the movable short circuit also including means for guiding the conductive member as the conductive member is moved along the transmission line;

wherein the conductive member includes a plate of conductive material that is configured to be slid along the transmission line; and the means for guiding the conductive member includes two guide-rail structures mounted on the substrate that extend along opposite sides of the transmission line in order to retain the conductive member in alignment with the transmission line.

11. A device as recited in claim 10, wherein the conductive member is configured to provide a first low impedance section of transmission line followed by a first high impedance section of transmission line and a second low impedance section of transmission line followed by a second high impedance section of transmission line.

12. A planar circuit, comprising:

a substrate, a planar antenna circuit on the substrate, and means defining an adjustable tuning element on the substrate for tuning the planar antenna circuit;

the adjustable tuning element including a transmission line on the substrate that is coupled to the planar antenna circuit and a conductive member that is configured to be moved to any of various locations along the transmission line in order to provide a low impedance path across the transmission line at any such location to which it is moved;

wherein the planar antenna circuit includes a planar antenna and a SIS junction device.

13. A circuit as recited in claim 12, wherein the adjustable tuning element is configured as a shunt tuner.

14. A circuit as recited in claim 13, further comprising a second adjustable tuning element configured as a series tuner.

* * * * *